United States Patent [19]

Cravens

[11] 4,028,981

[45] June 14, 1977

[54] CONNECTING DEVICE

[76] Inventor: Cecil W. Cravens, 28 Ayers, Jackson, Tenn. 38301

[22] Filed: Dec. 9, 1975

[21] Appl. No.: 639,243

[52] U.S. Cl. ..... 84/327; 24/208 R; 24/210; 24/211 R; 84/453

[51] Int. Cl.[2] ..... G10G 5/00

[58] Field of Search ..... 84/327, 267, 453; 24/208 R, 210, 90 R, DIG. 17, 73 GS, 9, 265 R, 211 R; 224/5 S

[56] References Cited

UNITED STATES PATENTS

| | | | |
|---|---|---|---|
| 364,501 | 6/1887 | Edwards | 24/210 |
| 2,001,629 | 5/1935 | Quasso | 24/73 GS |
| 2,643,039 | 6/1953 | Sottile | 84/327 |
| 3,037,416 | 6/1962 | Cunningham | 84/327 |
| 3,688,012 | 8/1972 | Vettel | 84/327 |

FOREIGN PATENTS OR APPLICATIONS

| | | | |
|---|---|---|---|
| 1,064,447 | 9/1959 | Germany | 24/208 R |

*Primary Examiner*—Lawrence R. Franklin
*Attorney, Agent, or Firm*—John R. Walker, III

[57] ABSTRACT

A connecting device for securing a support strap to a musical instrument. The connecting device includes a flexible, elongated strip member having a first end fixedly attached to the musical instrument and having a second end removably secured to the support strap. The second end is adapted to be attached to the support strap in such a manner that it will remain secured to the musical instrument regardless of any movement by the person playing the musical instrument and regardless of the condition of the support strap.

4 Claims, 4 Drawing Figures

CONNECTING DEVICE

BACKGROUND OF THE INVENTION

1. Field of the Invention

This invention relates to means for attaching support straps to musical instruments.

2. Description of the Prior Art

Heretofore, various means for attaching support straps to musical instruments have been developed. See, for example, Cunningham, U.S. Pat. No. 3,037,416; Raleigh, U.S. Pat. No. 3,102,446; Sottile, U.S. Pat. 3,323,698; Vettel, U.S. Pat. No. 3,688,012; and Brooks, U.S. Pat. No. 3,894,464. None of the above patents disclose or suggest the present invention.

Prior to the present invention, the most common method of attaching a support strap to a musical instrument was by providing the end of the support strap with a buttonhole-like aperture for coacting with a button-like member that was fixedly attached to the musical instrument. When support straps are attached to musical instruments in this manner, the support straps frequently become inadvertently disengaged from the musical instrument due to movement of the person playing the muscial instrument, the condition of the support strap, etc. Such inadvertent disengagement of the support strap from the musical instrument often results in damage to the musical instrument, etc.

SUMMARY OF THE INVENTION

The present invention is directed towards overcoming the problems and disadvantages of prior means for securing support straps to musical instruments. The concept of the present invention is to provide a flexible, elongated strip member having a first end for fixed attachment to the musical instrument and having a second end located remote from the first end for removable attachment to the support strap. Conveniently, the strip member may include a retaining means fixedly attached to the second end thereof. The retaining means may include a button-like member for coacting with a buttonhole-like aperture in the support strap to removably attach the support strap to the strip member. One of the objects of the present invention is to allow the button-like member to be flexibly attached to the musical instrument so that the button-like member will move with the support strap when the support strap is moved relative to the musical instrument thereby reducing any direct pull between the support strap and the button-like member.

DESCRIPTION OF THE PREFERRED EMBODIMENT

The connecting device 11 of the present invention is for use in securing a support strap S to a musical instrument M such as a guitar or the like. In general, the connecting device 11 of the present invention includes a flexible, elongated strip means 13 having a first end 13' for fixed attachment to the musical instrument M and having a second end 13'' located remote from the first end 13' for removable attachment to the support strap S. The strip means 13 may include a back portion 14 for reasons which will hereinafter become apparent.

Figure 4:
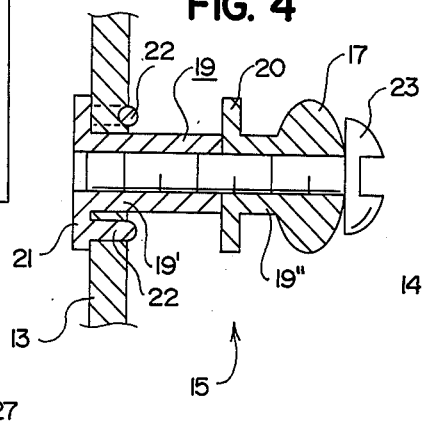
FIG. 4 is an enlarged sectional view of the retaining means of the connecting device of the present invention.

Conveniently, the connecting device 11 may include retaining means 15 for fixed attachment to the second end 13'' of the strip means 13. The retaining means 15 may include a button-like member 17 for coacting with a buttonhole-like aperture A provided in at least one end of the support strap S (see FIG. 3) to removably attach the support strap S to the second end 13'' of the strip means 13. Additionally, the retaining means 15 may include a stud-like member 19 having a first end 19' for attachment to the second end 13'' of the strip means 13 and having a second end 19'' for attachment to the button-like member 17 of the retaining means 15. The stud-like member 19 may include a flange portion 20 positioned intermediate the first and second ends 19', 19'' thereof for reasons which will hereinafter become apparent. The retaining means 15 may include a base member 21 having a plurality of prong portions 22 (as for example formed from bendable metal) for engaging the strip means 13 to attach the first end 19' of the stud-like member 19 to the strip means 13. It should be noted that the retaining means 15 may be constructed of two members joined together by a screw 23. More specifically, the base member 21 and the first end 19'' of the stud-like member 19 may be integrally constructed to form the first member and the flange portion 20, the second end 19'' of the stud-like member 19 and the button-like member 17 may be integrally constructed to form the second member (see FIGS. 3 and 4). The screw 23 may then pass through a bore in the second member and be threadingly received by the first member to fixedly join the first and second members together.

In addition, the connecting device 11 may include attachment means 24 for coacting with the musical instrument M to fixedly attach the first end 13' of the strip means 13 to the musical instrument M. The attachment means 24 may include a screw member 25 for extending through the first end 13' of the strip means 13 and into the musical instrument M to fixedly attach the first end 13' of the strip means 13 to the musical instrument M. The attachment means 24 may include a washer 27 for placement between the head 25' of the screw member 25 and the strip means 13.

Also, the connecting device 11 may include cover means 29 for coacting with the retaining means 15 to securely attach the support strap S to the retaining means 15. The cover means 29 may include a first end 29' for attachment to the first end 13' of the strip means 13 and may include a second end 29'' having a buttonhole-like aperture 31 therethrough (see FIG. 3) for fitting over the button-like member 17 of the retaining means 15 after the buttonhole-like aperture A of the support strap S has been fitted thereover to prevent the support strap S from being inadvertently removed from the retaining means 15 without the removal of the cover means 29 therefrom.

Figure 1:
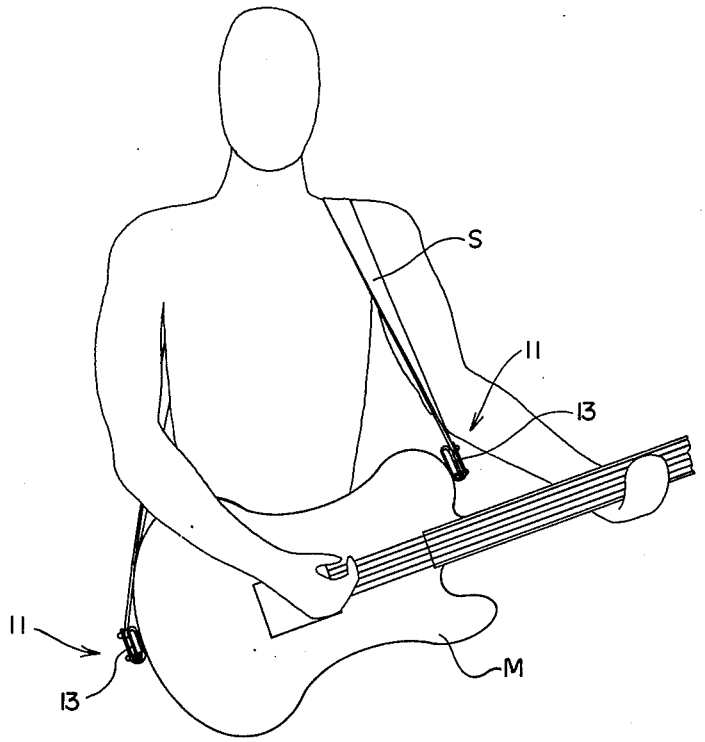
FIG. 1 is a front elevational view of a person playing a musical instrument having a support strap attached thereto by the connecting device of the present invention.
Figure 2:
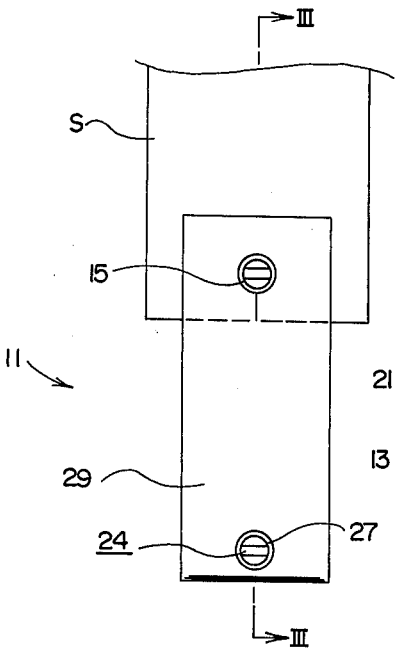
FIG. 2 is a front elevational view of a connecting device of the present invention showing a support strap for a musical instrument attached thereto.
Figure 3:
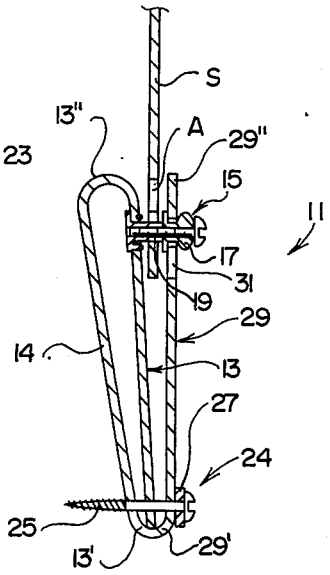
FIG. 3 is a sectional view of the connecting device of the present invention as taken on line III—III of FIG. 2.

The strip means 13 and the cover means 29 may be constructed of a single, unitary, elongated strip of flexible material such as leather, plastic, canvas or the like as clearly shown by FIGS. 1 and 3 of the drawings. More specifically, to form the strip means 13 and cover means 29, the elongated strip of flexible material is folded in thirds to form a three layer member with the outer layers forming the back portion 14 of the strip member 13 and the cover means 29 and with the base member 21 of the stud-like member 19 of the retaining means being attached to the inner layer.

To use the connecting means 11 of the present invention, the first step is to fixedly attach the first end 13' of the strip means 13 to the musical instrument M by the screw member 25. It should be noted that most musical instruments M such as guitars or the like include at least one and usually two support strap retaining devices mounted thereto by screws or the like. While the screw member 25 can be screwed into any suitable portion of the musical instrument M as should be apparent to those skilled in the art, it is preferred that the screw or the like holding the normal support strap retaining device to the musical instrument M be removed and replaced by the screw member 25 of the present invention so that the connecting device 11 of the present invention can be utilized without requiring any physical modification to the musical instrument M. Once the first end 13' of the strip means 13 is thusly attached to the musical instrument M, the support strap S can be attached to the retaining means 15 by passing the buttonhole-like aperture A of the supporting strap S over the button-like member 17 and the flange portion 20 of the retaining means 15. The back portion 14 of the strip means 13 will provide a barrier between the musical instrument M and the retaining means 15 to protect the musical instrument M from being damaged (e.g., scratched) by the base member 21 or the first end 19' of the stud-like member 19 of the retaining means 15. Finally, the second end 29'' of the cover means 29 is fitted over the button-like member 17 of the retaining means 15 by means of the button-like aperture 31 therein to prevent the support strap S from being inadvertently removed from the retaining means 15 without the removal of the cover means 29 therefrom and with the flange portion 20 of the retaining means 15 providing a barrier between the support strap S and the cover means 29.

It should be noted that two of the connecting devices 11 may be used in connection with any one musical instrument M to connect both ends of the supporting strap S thereto (see FIG. 1). More specifically, the supporting strap S may have a buttonhole-like aperture A adjacent the first and second ends thereof and two of the connecting devices 11 may be attached to the musical instrument M as spaced apart locations thereon for connecting either end of the supporting strap S to the musical instrument M.

As thus constructed and used, the present invention provides means for securing a supporting strap S to a musical instrument M in such a manner so that the supporting strap S will remain secured to the musical instrument M regardless of any movement by the person playing the musical instrument M, etc.

Although the invention has been described and illustrated with respect to a preferred embodiment thereof, it is not to be so limited since changes and modifications may be made therein which are within the full intended scope of the invention.

I claim:

1. A connecting device for securing a supporting strap to a musical instrument, said connecting device comprising a flexible, elongated strip means including a first end for fixed attachment to the musical instrument and including a second end for removable attachment to the supporting strap, said second end being located remote from said first end, at least one end of the supporting strap including a buttonhole-like aperture; retaining means for fixed attachment to said second end of said strip means, said retaining means including a button-like member for coacting with the buttonhole-like aperture in the supporting strap to removably attach the supporting strap to said second end of said strap means; and cover means for coacting with said retaining means to securely attach the supporting strap to said retaining means, said cover means including first and second ends, said first end of said cover means being attached to said first end of said strip means, said second end of said cover means including a buttonhole-like aperture for fitting over said button-like member of said retaining means after the buttonhole-like aperture of the supporting strap has been fitted thereover to prevent the supporting strap from being inadvertently removed from said retaining means without the removal of said cover means therefrom; said retaining means including a stud-like member having a first end and a second end, said first end of said stud-like member being attached to said second end of said strip means, said second end of said stud-like member being attached to said button-like member of said retaining means, said stud-like member including a flange portion intermediate said first and second ends thereof for providing a barrier between said second end of said cover means and the supporting strap when both are fitted over said button-like member of said retaining means.

2. The connecting device of claim 1 in which said strip means includes a back portion for covering said first end of said stud-like member of said retaining means to protect the musical instrument from said first end of said stud-like member of said retaining means.

3. A connecting device for securing a supporting strap having at least a first end with a buttonhole-like aperture therethrough to a musical instrument, said connecting device comprising: flexible, elongated strip means, said strip means being folded in thirds to form a first outer layer, an inner layer and a second layer, said inner layer having a first end for fixed attachment to the musical instrument and having a second end for removable attachment to the supporting strap, said second end being located remote from said first end; retaining means for fixed attachment to said second end of said inner layer of said strip means, said retaining means including a stud-like member having a first end and a second end, said retaining means including a base member having a plurality of prong portions for fixedly attaching said base member to said second end of said inner layer of said strip means, said first end of said stud-like member being fixedly attached to said base member, said retaining means including a button-like member fixedly attached to said second end of said stud-like member for coacting with the buttonhole-like aperture in the supporting strap to removably attach the supporting strap to said strip means, said retainer means including a flange portion fixedly attached to said stud-like member intermediate said first and second ends thereof; said first outer layer of said strip means being positioned between said base member of said retaining means and the musical instrument when said strip means is attached to the musical instrument and said retaining means is attached to said strip means for protecting the musical instrument from said base member of said retaining means, said second outer layer of said strip means having a buttonhole-like aperture therethrough for fitting over said button-like member of said retaining means after the buttonhole-like aperture of the supporting strap has been fitted thereover to prevent the supporting strap from being inadvertently removed from said retaining means without the removal of said second outer layer of said strip means therefrom, said flange portion of said retainer means providing a barrier between said second outer layer of said strip means and the supporting strap when both are fitted over said button-like member of said retaining means; and attachment means for coacting with the musical instrument to fixedly attach said first end of said inner layer of said strip member to the musical instrument, said attachment means including a screw member having a body portion for extending through said first end of said inner portion of said strip means and into the musical instrument and having a head portion for holding said first end of said inner layer of said strip means against the musical instrument when said body portion of said screw member extends into the musical instrument.

4. The combination with a muscial instrument and a supporting strap including at least a first end having a buttonhole therein, of a connecting device for removably securing the supporting strap to the musical instrument, said connecting device comprising: flexible, elongated strip means, said strip means being folded in thirds to form a first outer layer, an inner layer and a second outer layer, said inner layer having a first end fixedly attached to the musical instrument and having a second end removably attached to the supporting strap, said second end being located remote from said first end; retaining means fixedly attached to said second end of said inner layer of said strip means, said retaining means including a stud-like member having a first end and a second end, said retaining means including a base member having a plurality of prong portions fixedly attaching said base member to said second end of said inner layer of said strip means, said first end of said stud-like member being fixedly attached to said base member, said retaining means including a button-like member fixedly attached to said second end of said stud-like member for coacting with the buttonhole-like aperture in the supporting strap to removably attach the supporting strap to said strip means, said retainer means including a flange portion fixedly attached to said stud-like member intermediate said first and second ends thereof; said first outer layer of said strip means being positioned between said base member of said retaining means and the musical instrument when said strip means is attached to the musical instrument and said retaining means is attached to said strip means for protecting the musical instrument from said base member of said retaining means, said second outer layer of said strip means having a buttonhole-like aperture therethrough for fitting over said button-like member of said retaining means after the buttonhole-like aperture of the supporting strap has been fitted thereover to prevent the supporting strap from being inadvertently removed from said retaining means without the removal of said second outer layer of said strip means therefrom, said flange portion of said retainer means providing a barrier between said second outer layer of said strip means and the supporting strap when both are fitted over said button-like member of said retaining means; and attachment means for coacting with the musical instrument to fixedly attach said first end of said inner layer of said strip member to the musical instrument, said attachment means including a screw member having a body portion extending through said first end of said inner portion of said strip means and into the musical instrument and having a head portion for holding said first end of said inner layer of said strip means against the musical instrument when said body portion of said screw member extends into the musical instrument.

* * * * *